United States Patent [19]

Griffiths et al.

[11] Patent Number: 5,062,182

[45] Date of Patent: Nov. 5, 1991

[54] THREE LINK, SIX POINT HINGE ASSEMBLY FOR DECK LID

[75] Inventors: Guy G. V. Griffiths, Cheylesmore Coventry, England; James Bolsworth, Sterling Heights; John M. Appleby, Warren, both of Mich.

[73] Assignee: General Motors Corporation, Detroit, Mich.

[21] Appl. No.: 465,867

[22] Filed: Jan. 16, 1990

[51] Int. Cl.[5] ..... E05D 15/00

[52] U.S. Cl. ..... 16/368; 16/360; 16/302

[58] Field of Search ..... 16/368, 370, 360, 302

[56] References Cited

U.S. PATENT DOCUMENTS

| | | | |
|---|---|---|---|
| 1,864,164 | 6/1932 | Aldeen . | |
| 1,965,316 | 7/1934 | Predmore | 16/166 |
| 2,173,644 | 9/1939 | Blackmore | 16/163 |
| 2,258,065 | 10/1941 | Orlow | 16/163 |
| 2,743,476 | 5/1956 | Turner | 16/141 |
| 2,769,659 | 11/1956 | Perry et al. | 16/368 |
| 3,673,635 | 7/1972 | Cencioni | 16/163 |
| 4,587,760 | 5/1986 | Brissette | 49/252 |

FOREIGN PATENT DOCUMENTS

| | | | |
|---|---|---|---|
| 1559864 | 2/1970 | Fed. Rep. of Germany | 16/360 |
| 2168107 | 6/1986 | United Kingdom | 16/370 |

*Primary Examiner*—Lowell A. Larson
*Assistant Examiner*—Michael J. McKeon
*Attorney, Agent, or Firm*—William A. Schuetz

[57] ABSTRACT

The present invention provides a hinge assembly which comprises a three link, six pivot linkage arrangements constructed and arranged such that when a deck lid is being initially moved from its closed position toward an open position the deck lid will be caused to be rapidly moved vertically upward from its associated seal means with only very minor pivotal movement until the closure panel clears the seal means located adjacent the hinge assemblies whereby the exertion of transverse forces against the seal means due to any wiping action of the closure panel on the seal means as it is initially moved to its open position is minimized.

7 Claims, 2 Drawing Sheets

THREE LINK, SIX POINT HINGE ASSEMBLY FOR DECK LID

The present invention relates to a hinge assembly for a vehicle closure panel, such as a deck lid, and, more particularly, to a deck lid hinge assembly in which the deck lid is caused to be rapidly moved vertically upwardly from an associated seal means when initially opened so that exertion of transverse forces against the seal means due to wiping action of the deck on the seal means is minimized.

Deck lids for vehicle trunk compartments are usually pivotally connected to associated vehicle body structure via curved or goose necked hinge straps. The hinge straps are secured to the deck lid at its underside and pivotally connected to the body structure forwardly of the deck lid for rotation about a fixed horizontal axis. The deck lids when closed seat against an elastomeric seal means surrounding the opening in the trunk compartment. During initial opening movement of the deck lid (as well as during the final closing movement thereof), the deck lid engages the seal means with a 'wiping' action. That is, it exerts transverse forces against the seal means which tend to distort the same inward toward the trunk compartment. This wiping and distortion of the seal means, after repeated opening and closings of the deck lid, can cause the seal means to eventually become dislodged from its associated mounting on the body structure surrounding the opening of the trunk compartment.

The present invention provides a novel hinge assembly which overcomes the above-noted problems. In accordance with the provisions of the present invention, a novel three link, six pivot linkage arrangement is provided and which is constructed and arranged such that, when the deck lid is being initially moved from its closed position toward an open position, a deck lid is caused to be rapidly moved vertically upwardly from the seal means with only very minor pivotal movement until the deck lid clears the seal means located adjacent the hinge assemblies whereby the exertion of transverse forces against the seal means due to any wiping action of the deck lid panel on the seal means is minimized.

Accordingly, it is an object of the present invention to provide a new and improved hinge assembly for a vehicle closure panel, such as a deck lid of an automotive vehicle, and in which the novel hinge assembly comprises a three link, six pivot linkage arrangement operatively pivotally connected to the closure panel or deck lid and both pivotally and slidably connected to the body structure, and with the linkage arrangement being constructed and arranged such that, when the closure panel or deck lid is being initially moved from its closed position toward an open position, it rapidly moves vertically upward from an associated seal means until it clears the seal means adjacent its pivotal connection to the body structure whereby any exertion of transverse forces against the seal means due to the closure panel or deck lid wiping against the seal means is minimized.

Another object of the present invention is to provide a new and improved hinge assembly for a deck lid, as defined in the next preceding object, and wherein the linkage arrangement causes the deck lid, after its initial upward movement thereof, to be pivotally moved, with only slight further upward movement, as the deck lid is moved towards its fully open position.

Yet another object of the present invention is to provide a new and improved hinge assembly for a deck lid, as defined in the preceding objects, and in which the linkage arrangement comprises a first link having one end pivotally connected to the deck lid adjacent its front end and its other end pivotally connected and slidably connected to a support member on the body structure located adjacent the front end of the deck lid, a second link pivotally connected intermediate its ends to the first link at a location intermediate the opposite ends of the first link and which has one end pivotally connected to the support member, and a third link having one end pivotally connected to the deck lid at a location spaced further rearwardly than the first links pivotal connection thereto and its other end pivotally connected to the second link at its end remote from its pivotal connection with the body structure, and in which the first link is slidably connected to the body structure via a non-linear slot, the linkage arrangement and the slot in the support having a configuration such that, when the deck lid is being initially moved from its closed position toward its open position, the deck lid is caused to be rapidly moved vertically upwardly from the seal means with only a very little pivotal movement until the front end of the deck lid clears the seal means whereby the exertion of transverse forces against the seal means due to any wiping action of the deck lid as it is being initially moved to its open position is minimized.

The present invention further resides in various novel constructions and arrangement of parts, and further objects, novel characteristics and advantages of the present invention will be apparent to those skilled in the art to which it relates and from the following detailed description of the illustrated, preferred embodiment thereof made with reference to the accompanying drawings forming a part of this specification and in which similar reference numerals are employed to designate corresponding parts throughout the several views, and in which.

Figure 4:
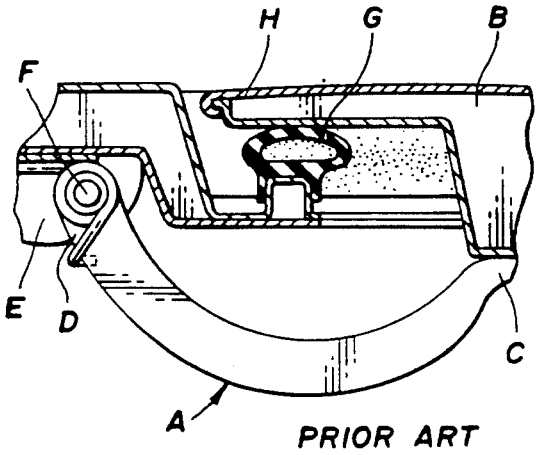
FIG. 4 is a fragmentary side elevational view, with parts shown in section, of a typical prior art type of hinge means for a deck lid.

Referring first to FIG. 4, a typical or customary hinge means A for swingably supporting a deck lid B for movement between open and closed positions is thereshown. The hinge comprises a goose neck or curved strap having one end C which is secured to the deck lid B at its underside and which has its other end D pivotally secured to a support or hinge box E via a pivot means F. The deck lid B shown in FIG. 4 is in its closed position in which its underside engages and compresses an elastomeric seal means G, the seal means G extending around the periphery of the deck lid or trunk opening. The seal means 9 is distorted inwardly of the trunk, as shown in FIG. 4.

Figure 5:
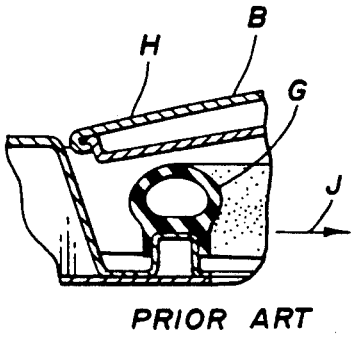
FIG. 5 is a fragmentary elevational view like that shown in FIG. 4 but showing different parts thereof in different positions.

In such a construction, the deck lid B upon being moved from its closed position, as shown in FIG. 4, toward an open position, as shown in FIG. 5, pivots about the pivot F. During the initial pivotal opening movement, the deck lid B at its rear end H further compresses the seal means G and distorts the same inwardly toward the trunk compartment. That is, as the deck lid B is pivoted, its rear end H wipes against the seal means G and causes transverse forces to be exerted thereon in the direction of the arrow J which causes the seal means to be distorted inwardly toward the trunk compartment until it is pivotally moved a sufficient distance in which the rear end H clears the seal means G. Likewise, when the deck lid B approaches its final closed position, it will again engage the seal means G and cause a wiping action to distort the seal means inwardly toward the trunk compartment, as shown by the direction arrow J in FIG. 5. If the seal means G is not very securely retained on the body structure of the vehicle, this wiping action after repeated opening and closing movements of the deck lid B, could eventually cause the seal means G to become dislodged from its mounting. In addition, this constant stressing of the seal means G could cause premature wear or require the use of a more expensive elastomeric seal means which has a longer life after repeated stressing.

Figure 1:
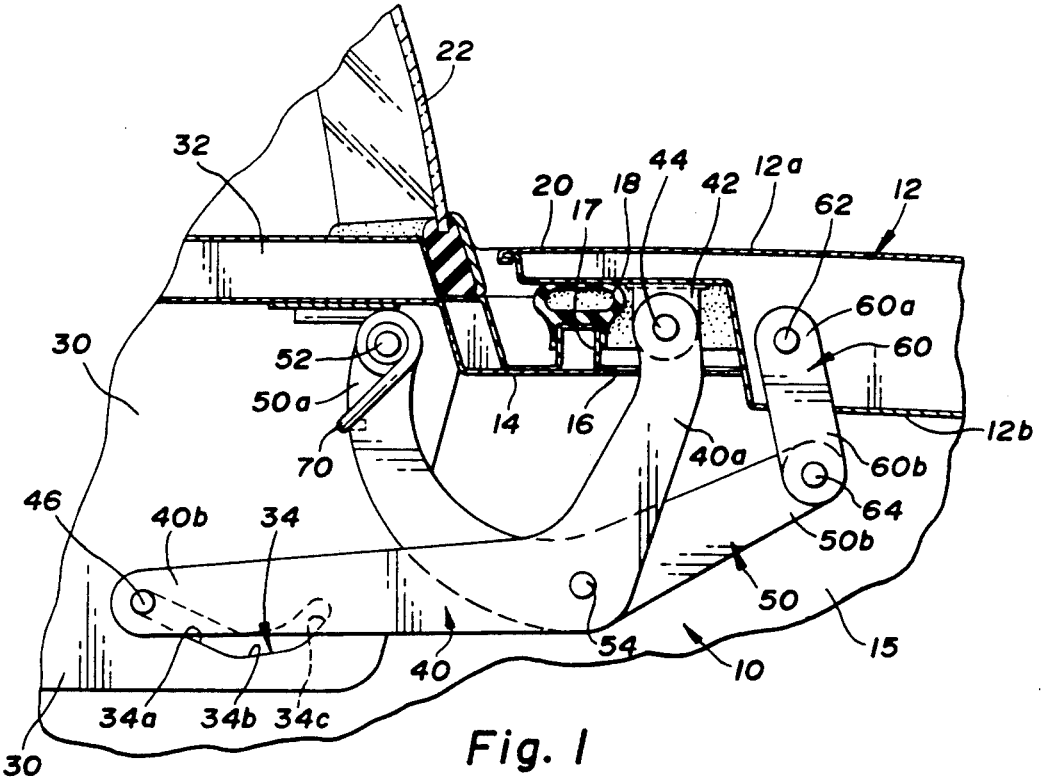
FIG. 1 is a fragmentary side elevational view of the novel hinge assembly of the present invention and with parts thereof shown in cross section.

In accordance with the provisions of the present invention, a novel hinge assembly or system 10 is provided which overcomes the above-noted problems. Although the novel hinge assembly 10 could be used in connection with any type of vehicle closure panel, for example a hood, it is particularly adapted for use with a deck lid 12 of an automotive vehicle. The automotive vehicle would have rear body structure 14 which defines a trunk compartment 15 and in a manner well known to those skilled in the art. Accordingly, only a portion of the body structure 14 is shown in the drawing. The body structure 14 would have an upper opening 16 which is defined by a peripheral inverted U-shaped mounting flange 17 secured to the body structure 14. Secured to the peripheral flange 17 is an elastomeric seal means 18. The elastomeric seal means 18 is hereshown as having a hollow body portion so as to be readily compressible by the deck lid 12 when the latter is in its closed position, as shown in FIG. 1. The deck lid 12 could be of any suitable or conventional construction and is hereshown as including an outer sheet metal panel 12*a* and an inner sheet metal panel 12*b* which is welded or otherwise secured to the outer panel 12*a*. As shown in FIG. 1, the deck lid 12 has a forward end 20 located closely adjacent a rear window 22 for the vehicle.

Figure 3:
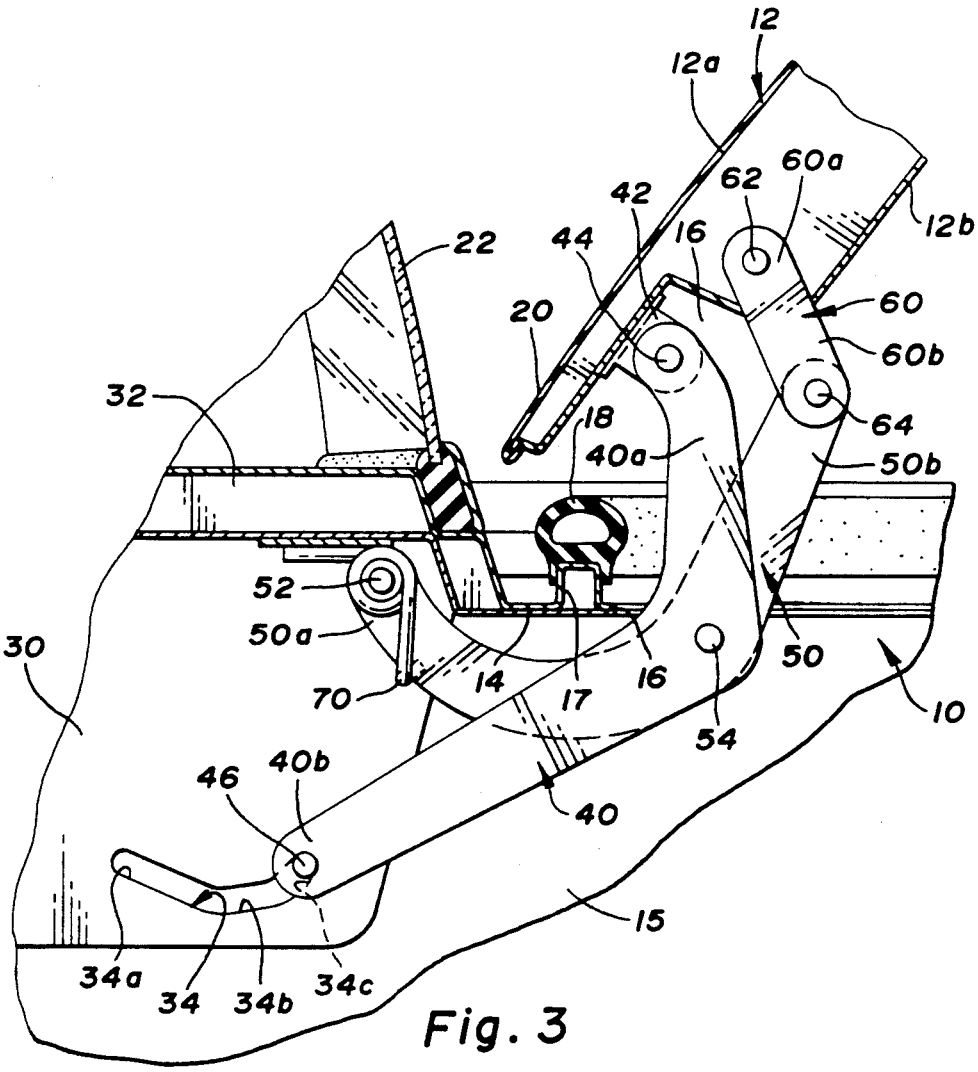
FIG. 3 is a view like that shown in FIG. 1, but showing different parts thereof in different positions.

The novel hinge assembly 10 swingably supports the deck lid 12 for movements between a closed position, as shown in FIG. 1, and a fully open position, as shown in FIG. 3. The novel hinge assembly 10 comprises a support or support panel 30 which is secured to the vehicle body structure 14 at a location beneath a rear support panel 32 adjacent the rear window 22 of the vehicle. The support member 30 extends vertically downwardly and is provided with a non-linear slot 34 which extends longitudinally of the vehicle. The slot 34 is of a generally inverted trapezoidal shape and comprises, as viewed in FIG. 1, a substantially linear left end portion 34*a*, a substantially linear midportion 34*b* and a substantially linear right end portion 34*c*. The left end portion 34*a* extends downwardly from the rear support panel 32 proceeding from its left end toward its right end whereby its longitudinal axis forms an acute included angle with respect to a horizontal plane. The midportion 34*b* slopes slightly upwardly toward the deck lid proceeding from its left end toward its right end. The right end portion 34*c* slopes even at a greater upward angle toward the deck lid 12 proceeding from its left end toward its right end than the midportion 34*b* whereby its longitudinal axis forms an acute included angle with respect to a horizontal plane.

The novel hinge assembly 10 also comprises a three link, six pivot linkage arrangement. The linkage arrangement comprises a first link 40 which is generally L-shaped or boomerang shaped. The link 40 has one end 40*a* pivotally connected to a downwardly extending bracket 42 secured to the underside of the front end 20 of the deck lid 12 via a first pivot pin means 44. The link 40 has its other end 40*b* both pivotally and slidably connected to the support member 30 via a second pivot pin means 46. The second pivot pin means 46 is both pivotally and slidably connected to the support member and extends through the slot 34. The linkage arrangement or means further comprises a second link 50 which has one end 50*a* pivotally connected to a third pivot pin means 52 to support member 30 and is also pivotally connected intermediate its ends to the link 40 intermediate the ends of the latter via a fourth pivot pin means 54. The linkage arrangement further includes a third link 60 which has one end 60*a* pivotally connected to the inner panel 12*b* of the deck lid 12 via a fifth pivot pin means 62 and has its other end 60*b* pivotally connected to the end 50*b* of the second link 50 via a sixth pivot pin means 64. The link 60 is relatively short and is linear. All of the links 40, 50 and 60 are planar and with the link 50 being J-shaped, as clearly shown in the drawings.

The deck lid 12 is adapted to be biased toward a fully open position by a conventional torsion spring 70. The torsion spring 70 would have one end connected to the body structure 14 of the vehicle and its other end in engagement with the link 50 so that it biases the link 50 and deck lid 12 for movement in a counterclockwise direction, as viewed in FIG. 1.

The operation of the novel hinge assembly 10 will now be described in detail. When the deck lid 12 is in its closed position, it is locked in this position by a suitable or conventional lock mechanism (not shown) at its end remote from the front end 20. When in this closed position, the lock mechanism holds it in this position against the biasing force of the torsion spring 70.

As can be seen from FIG. 1 of the drawings, when the deck lid 12 is in its closed position, it has compressed the seal means 18 in an even manner. The seal means 18 when not compressed has a configuration shown in FIGS. 2 and 3. When the lock mechanism (not shown) is released to allow the deck lid 12 to be moved toward an open position, the torsion spring 70 causes the link 50 to be pivoted about the axis of the pivot pin means 52. Normally, initial opening movement due to the pivotal movement of a link, such as link 50, would cause the front end 20 of the deck lid to wipe against the seal means 18. However, due to the provision of the link 40 and its slidable connection with the slot 34, the pivot means 46 is caused to slide downwardly and toward the right by the first portion 34*a* of the slot 34. This downward movement causes the link 40 to pivot in a counterclockwise direction with respect to the link 50 about the axis of pivot pin means 54 and its pivotal connection with the deck lid 12 via pivot means 44 causes the deck lid 12 to be rapidly moved vertically upwardly during its initial opening movement. Although a minor amount of angular movement, i.e., pivotal movement of the deck lid 12 about the axis of the pivot means 52 takes place, this movement is very minor in comparison to the upward vertical movement of the deck lid 12 during this initial opening movement.

Figure 2:
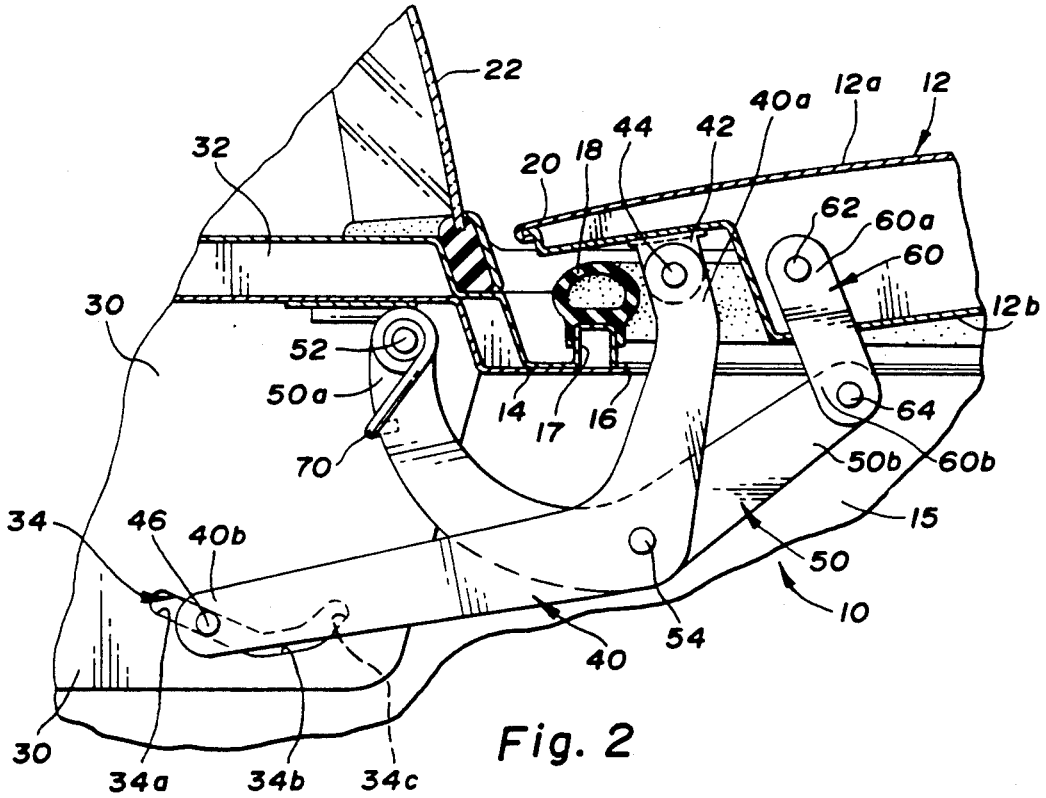
FIG. 2 is a view like that shown in FIG. 1, but showing different parts thereof in different positions.

When the underside of the front end 20 of the deck lid 12 clears or disengages from the seal means 18, the pivot means 46 will be located at the lower end of the first portion 34*a* of the slot 34, as shown in FIG. 2. Furthermore, opening movement of the deck lid 12 by the torsion spring 70 will cause the pivot pin means 46 to ride in the intermediate portions 34*b* of the slot 34 and thereafter through portion 34*c* of the slot 34. Once the deck lid is moved to the position shown in FIG. 2, further opening movement thereof is primarily pivotal about the axis of the pivot pin means 52 and the axis of the pivot pin means 44 and with the amount of vertical movement of the rear 20 of the deck lid being minimal. When the deck lid 12 is in its fully open position, the various linkages are in the position shown in FIG. 3.

When the deck lid 12 is moved from its open position to its closed position in opposition to the biasing force of the torsion spring 70, the reverse movements take place. That is, during the final phase of the closing movement, the front end of the deck lid 12 will be moved primarily vertically downwardly and engage the elastomeric seal means 18 adjacent its top center so that further downward movement will compress the elastomeric seal means 18 equally and cause the same to be bulged both forwardly and rearwardly of the vehicle in an equal manner, as shown in FIG. 1.

From the foregoing, it should be apparent that a novel hinge assembly 10 has been provided. The novel hinge assembly 10 functions to move the deck lid 12 rapidly upwardly in a vertical direction during its initial opening movement and during the final phase of its closing movement so that the front of the deck lid 12 does not wipe over and cause distortion of the elastomeric seal means 18 to occur due to the imposition of transverse forces bulging the seal means 18 inwardly toward the trunk compartment 15. That is, such wiping action is minimized so that the seal means 18 is engaged virtually top dead center and has its sides compressed equally. The advantages of such a construction are that the elastomeric seal means 18 will not become dislodged after repeated opening and closing movements of the deck lid 12, does not need to be as securely retained on its mounting structure 17 and it is not subject to as much stress and wear and tear.

Although the illustrated embodiment thereof has been described in great detail, it should be apparent that certain modifications, changes and adaptations may be made in the illustrated embodiment, and that it is intended to cover all such modifications, changes and adaptations which come within the spirit of the present invention.

The embodiments of the invention in which an exclusive property or privilege is claimed are defined as follows:

1. In an automotive vehicle having rear body structure whose upper periphery defines an access opening to a trunk compartment, a compressible elastomeric seal means carried by said upper periphery of said body structure, a deck lid for said access opening, and a pair of laterally spaced hinge assemblies connected with said deck lid adjacent its front end and pivotally connected with said rear body structure adjacent said front end of said deck lid, said hinge assemblies swingably supporting said deck lid for movement between an open position to afford access to said compartment and a closed position in which said deck lid compresses said seal means and closes off access to said compartment, the improvement being that said hinge assemblies each comprise a linkage means including a three link, six pivot linkage arrangement operatively pivotally connected to said deck lid and operatively both pivotally and slidably connected to said body structure, said linkage arrangement comprising a first link having one end pivotally connected via a first pivot means to said deck lid adjacent its front end and its other end pivotally and slidably connected by a second pivot means to a support member on said body structure located adjacent the front end of said deck lid, said support member on said body structure having a non-linear slot extending longitudinally of said vehicle and whose intermediate portion is lower than its first and second opposite ends, as viewed in side elevation, said second pivot means being pivotally and slidably received in said slot, a second link pivotally connected intermediate its ends to said first link at a location intermediate the opposite ends of said first link via a third pivot means, said second link at one end being pivotally connected via a fourth pivot means to said support member, a third link having one end pivotally connected via a fifth pivot means to said deck lid at a location spaced further rearwardly than said first pivot means and its other end pivotally connected via a sixth pivot means to the second link at its end remote from said fourth pivot means, said second pivot means being located adjacent said first end of said slot when said deck lid is in its closed position, said linkage arrangement and said slot in said support having a configuration such that, when the deck lid is being initially moved from its closed position toward an open position, the deck lid is caused to be rapidly moved vertically upward from said seal means with only a very little pivotal movement until the front end of the deck lid clears said seal means whereby the exertion of transverse forces against said seal means due to any wiping action of said deck lid as it is being initially moved to its open position is minimized.

2. In an automotive vehicle, as defined in claim 1, and wherein said linkage arrangement causes said deck lid, after said initial upward movement thereof, to be pivotally moved with only slight further upward vertical movement of said front end of said deck lid as the deck lid is further moved toward its full open position.

3. In an automotive vehicle, as defined in claim 2, and wherein said first link is generally L-shaped and said second link is J-shaped.

4. In an automotive vehicle, as defined in claim 3, and wherein said slot in said support member is generally shaped like an inverted trapezoid.

5. In an automotive vehicle, as defined in claim 4, and wherein said third link is linear.

6. In an automotive vehicle having body structure whose upper periphery defines an access opening to a compartment, a compressible elastomeric seal means carried by said upper periphery of said body structure, a closure panel for said access opening, and a pair of laterally spaced hinge assemblies connected with said closure panel adjacent one end thereof and pivotally connected with said body structure adjacent said one end of said closure panel, said hinge assemblies swingably supporting said closure panel for movement between an open position to afford access to said compartment and a closed position in which said closure panel compresses said seal means and closes off access to said compartment, the improvement being that said hinge assemblies each comprise a linkage means including a three link, six pivot linkage arrangement operatively pivotally connected to said closure panel and operatively both pivotally and slidably connected to said body structure, said linkage arrangement comprising a first link having one end pivotally connected via a first pivot means to said closure panel adjacent said one end thereof and its other end pivotally and slidably connected by a second pivot means to a support member on said body structure located adjacent said one end of said closure panel, said support member on said body structure having a non-linear slot extending longitudinally of said vehicle and whose intermediate portion is lower than its first and second opposite ends, as viewed in side elevation, said second pivot means being pivotally and slidably received in said slot, a second link pivotally connected intermediate its ends to said first link at a location intermediate the opposite ends of said first link via a third pivot means, said second link at one end being pivotally connected via a fourth pivot means to said support member, a third link having one end pivotally connected via a fifth pivot means to said closure panel at a location spaced further away than said first pivot means from said one end of said closure panel and its other end pivotally connected via a sixth pivot means to the second link at its end remote from said fourth pivot means, said second pivot means being located adjacent said first end of said slot when said closure panel is in its closed position, said linkage arrangement and said slot in said support having a configuration such that, when the closure panel is being initially moved from its closed position toward an open position, the closure panel is caused to be rapidly moved vertically upward from said seal means with only a very little pivotal movement until said one end of the closure panel clears said seal means whereby the exertion of transverse forces against said seal means due to any wiping action of said closure panel as it is being initially moved to its open position is minimized.

7. In an automotive vehicle, as defined in claim 6, and wherein said linkage arrangement causes said closure panel, after said initial upward movement thereof, to be pivotally moved with only slight further upward vertical movement of said one end of said closure panel movement as the closure panel is further moved toward its full open position.

* * * * *